United States Patent [19]

Bengtsson

[11] 4,001,924

[45] Jan. 11, 1977

[54] FITTING FOR ATTACHMENT TO A PIECE OF FABRIC

[76] Inventor: Sigurd Walter Bengtsson, Bruksgatan 17, 41451 Goteborg, Sweden

[22] Filed: June 10, 1975

[21] Appl. No.: 585,497

[30] Foreign Application Priority Data

June 12, 1974 Sweden ..... 7407732

[52] U.S. Cl. ..... 24/230 F; 2/265; 24/216

[51] Int. Cl.[2] ..... A44B 19/00

[58] Field of Search ..... 24/230 CF, 230 F, 216, 24/230 R, 230 SC, DIG. 29, 90 R, 90 C; 2/265

[56] References Cited

UNITED STATES PATENTS

| | | | |
|---|---|---|---|
| 3,167,835 | 2/1965 | Bengtsson | 24/230 SC |
| 3,699,617 | 10/1972 | Hotmeister | 24/Dig. 29 |
| 3,774,756 | 11/1973 | Cox et al. | 24/216 |

FOREIGN PATENTS OR APPLICATIONS

| | | | |
|---|---|---|---|
| 200,587 | 3/1965 | Sweden | 24/230 F |

*Primary Examiner*—G. V. Larkin
*Attorney, Agent, or Firm*—Hill, Gross, Simpson, Van Santen, Steadman, Chiara & Simpson

[57] ABSTRACT

A buckle part or fitting to be attached to a piece of fabric includes first and second parts adapted to be held in position by at least one post passing through the fabric, one of said parts being provided with a recess and the other part having a raised portion of somewhat smaller peripheral size than the recess, so the fabric will be compressed into the recess when the two parts are clamped together. The two parts are made of a material having high frictional properties, whereby the posts are self locking in their mating bores; in fittings subjected to heavy wear, an extra post adapted to be upset in its bore may be provided as a safety measure.

8 Claims, 4 Drawing Figures

FITTING FOR ATTACHMENT TO A PIECE OF FABRIC

BACKGROUND OF THE INVENTION

1. Field of the Invention:

This invention relates to buckles, such as for clothing.

2. Prior Art:

Many pieces of clothing are provided with buckles or fasteners, referred to herein as fittings comprising a male portion and a female portion intended for interengagement, for instance in connection with fixed suspenders of workmen's trousers or overalls of the bib type, or with protecting coats of different kinds.

As such fittings usually are manufactured in large production quantities and the fittings, in use, often are subjected to high loads and rough handling, the requirements are, that the fittings shall be easy to mount and, when mounted, shall be retained at the fabric without tearing the same.

There are many ways of attaching a fitting to a piece of fabric. A typical fitting includes a first part adapted to be fitted with a sideface abutting the fabric and a second part for fitting against the opposite face of the fabric, said parts, in mounted position, being kept together by means of at least one post extending from one of said parts, passing through the fabric and entering a bore in the other of said parts, in which bore the post is retained. Thus the manner of attachment of such prior parts is not totally unlike a riveting operation. Such attachment is usually simple to perform, but the fitting will easily tear the fabric if subjected to a heavy load. Further an efficient riveting operation will usually require some form of machinery or equipment to perform the riveting.

SUMMARY OF THE INVENTION

A marked simplification of the mounting operation and highly improved properties with respect to the retention at the fabric is, according to the invention, attained by a buckle part or fitting having first and second parts of synthetic resin having high frictional properties, at least one post or a mating bore, respectively, located within a recess in one of said parts, and the other part having a mating raised portion of the same shape as the recess, but having a smaller peripheral size than the latter, whereby a clearance approximately corresponding to the thickness of the fabric is formed, and within which portion the bore or the post, respectively, is disposed. The depth of the recess exceeds the thickness of the fabric and the length and other dimensions of the post are selected in such a manner with respect to the bore that a retention of the parts is obtained when the fabric has been clamped between the parts.

DESCRIPTION OF THE PREFERRED EMBODIMENTS

Figure 1:
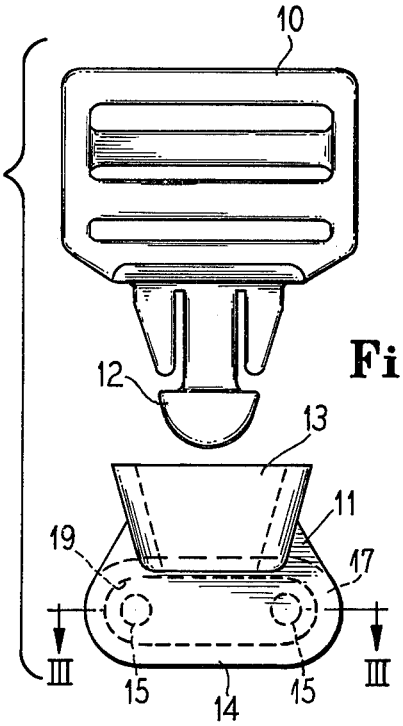
FIG. 1 is a front view of such a buckle or fitting, with its male and female portions separated.
Figure 2:
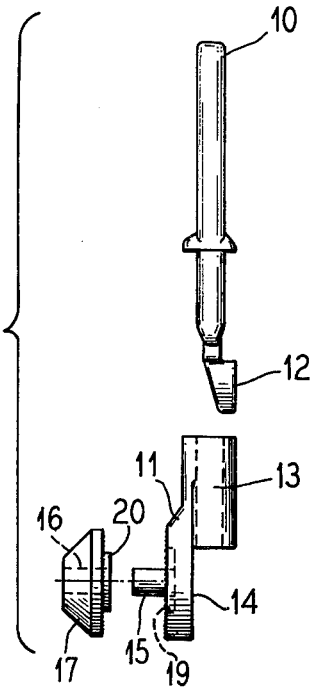
FIG. 2 is a side view thereof.

The buckle or fitting shown in FIGS. 1 and 2 is intended for a pair of workmen's trousers, so called carpenter's trousers (known in the U.S.A. as bib overalls), and comprises a male portion 10 and a female portion 11, two such buckles being provided for each pair of trousers. The male portion 10 is attached to the end of one of the suspenders and is constructed in such a manner that the length of the suspender may be easily adjusted. This portion of the buckle is furthermore provided with a resilient tongue 12 adapted for cooperation with a sleeve 13 on the female portion.

The female portion 11, which is to be attached to the breast flap of the trousers, includes a plate 14, which here is called the first part of this fitting. This first part is provided with two posts 15, which are adapted to cooperate with a pair of bores 16 in a second part 17.

Figure 3:
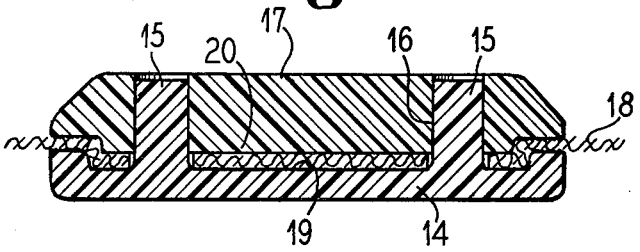
FIG. 3 on a larger scale is a cross-sectional view taken along line III—III of FIG. 1.

The cooperation between the first and the second parts, when clamped to a piece of fabric 18 is shown in FIG. 3.

The posts 15 in the first part 14 are disposed within a recess 19. The recess 19 is defined by circular arcs concentric with the posts 15, and straight side lines interconnecting the arcs. The depth of the recess is somewhat greater than the thickness of the fabric.

The second part 17 is provided with a raised portion 20, having substantially the same contour line as the recess 19, but is smaller than the same by an amount corresponding to the thickness of the fabric.

The female portion 11, i.e. its first as well as its second parts 14, 17, is manufactured of synthetic resin having high frictional properties. A suitable material is an acetal resin, commercially available from E. I. DuPont de Nemours and Company under the trade mark DELRIN.

When the fitting is to be mounted, holes for the posts need not be pre-punched in the fabric. The end faces of the posts and the mouths of the bores are shaped like a punch and a die. By locating the male and the female parts on opposite sides of the fabric, in exact registration, the two parts can then be forced together. The fitting parts punch the necessary holes by themselves during such assembly.

Each post preferably has a slightly larger diameter then that of the bore to provide a negative clearance, and the frictional properties of the material ensure a secure retention of the first and the second parts, which normally will not be subjected to any significant load in the axial direction of the posts.

When the two parts are clamped together, the fabric 18 is compressed into the recess 19 in the manner shown in FIG. 3. A stretching of the fabric, i.e. a load perpendicular to the posts will mainly be resisted along the perimeter of the recess 19 and the raised portion 20, respectively. The load is in this manner distributed over a considerably greater area than would be the case with a conventional riveted fitting, where the load is transferred directly at the post.

Figure 4:
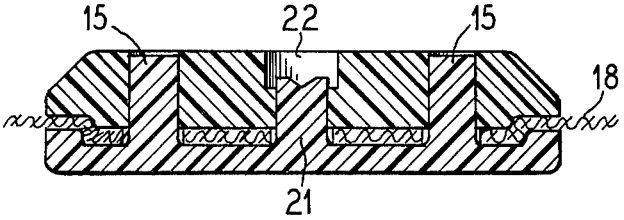
FIG. 4 is a corresponding cross-sectional view through a modified fitting adapted to support a heavy load.

A fitting or buckle adapted to take care of large loads, or suitable when there is a risk of rough handling, for instance pieces of clothing often passing through washing machines, is shown in FIG. 4.

The first and the second parts include the features of the embodiment described above, but here an added safety post 21 is disposed intermediate the two frictional posts 15. The safety post 21 is somewhat shorter than the posts 15 and cooperates with a mating bore in the second part which has a counterbore 22 to facilitate accessibility of an upsetting tool (not shown) to the end of the safety post 21. Thus an added mechanical locking of the two parts is obtained as an extra safety measure.

The posts may be arranged in many ways, and for many uses a single post is sufficient. Two posts are preferably located along a line perpendicular to the main direction of the load, and with the embodiment shown in FIG. 4 it is advantageous to locate all three posts along a line, with the safety post 21 intermediate the two frictional posts 15.

For ease in manufacturing, it is preferable to locate the post 15 in the part having the recess 19, while the bores 16 are located in the part having the raised portion 20. Other arrangements are, however, possible within the scope of the appended claims, the male portion 10 may be attached to the fabric by the means above described for the portion 11, if its position can be fixed, and not adjustable.

In order to further improve the retention of the fabric between the first and the second parts, the faces thereof coming into direct contact with the fabric may be roughened or knurled as shown in my copending U.S. application, serial number 585,144 filed June 9, 1975 but having the same effective filing date as shown in my copending U.S. application, Ser. No. 585,114 filed June 9, 1975 but having the same effective filing date.

Although various minor modifications might be suggested by those versed in the art, it is to be understood that I wish to embody within the scope of the patent warranted hereon all such embodiments as reasonably come within the scope of my contribution to the art.

I claim as my invention:

1. A buckle having a portion for being attached to fabric, comprising:

a. a first part having a side face for being disposed against one side of the fabric;

b. a second part having a side face for being disposed against the other side of the fabric;

c. at least one post extending from one of said parts for passing through the fabric into a bore in the other of said parts; and d. a recess in one of said side faces and a raised portion of complemental shape on the other of said side faces extending about said at least one post and receivable in said recess, there being a peripheral clearance between said recess and said raised portion corresponding to the thickness of the fabric.

2. A buckle according to claim 1 in which said first and second parts comprise a synthetic resin having high frictional properties, whereby said post is retained in said bore.

3. A buckle according to claim 1 in which said post projects out of said recess into said bore in said raised portion.

4. A buckle according to claim 1 which includes at least two of said posts and bores located along a line substantially perpendicular to the direction in which the buckle is to be tensioned.

5. A buckle according to claim 1 in which said side faces have a rough finish.

6. A buckle according to claim 1 having an additional shorter post projecting from one of said parts into an additional bore in the other of said parts, said additional bore having a counterbore into which said additional post can project and which counterbore is receptive of an upsetting tool for acting on the free end of said additional post.

7. A buckle according to claim 6 in which at least two of said posts and bores which, along with said additional post and bore, are located on a line substantially perpendicular to the direction in which the buckle is to be tensioned.

8. A buckle according to claim 1 in which said recess has a depth greater than the height of said raised portion whereby the fabric can be positively clamped by the portions of said parts which surround said recess and said raised portion.

* * * * *